US011702855B1

(12) United States Patent
Fan

(10) Patent No.: US 11,702,855 B1
(45) Date of Patent: Jul. 18, 2023

(54) ANTI-SEISMIC BRACED SCISSOR STAIRS AND FRAME STAIRS SYSTEM

(71) Applicant: CHINA AEROSPACE CONSTRUCTION ENGINEERING GROUP CO., LTD., Beijing (CN)

(72) Inventor: Xing Fan, Beijing (CN)

(73) Assignee: CHINA AEROSPACE CONSTRUCTION ENGINEERING GROUP CO., Beijing (CN)

( * ) Notice: Subject to any disclaimer, the term of this patent is extended or adjusted under 35 U.S.C. 154(b) by 0 days.

(21) Appl. No.: 18/116,895

(22) Filed: Mar. 3, 2023

(30) Foreign Application Priority Data

Jul. 26, 2022 (CN) ..... 202210882709.3

(51) Int. Cl.
*E04H 9/02* (2006.01)
*E04F 11/022* (2006.01)

(52) U.S. Cl.
CPC ..... *E04H 9/021* (2013.01); *E04F 11/022* (2013.01)

(58) Field of Classification Search
CPC ..... E04H 9/021; E04F 11/022
See application file for complete search history.

(56) References Cited

U.S. PATENT DOCUMENTS 7,976,746 B2 * 7/2011 Conservano ..... E04F 11/022 264/33
8,910,434 B2 * 12/2014 Zirbel ..... B28B 7/225 52/190
2008/0115429 A1 * 5/2008 Zirbel ..... E04F 11/02 52/600
2008/0236065 A1 * 10/2008 Conservano ..... E04F 11/022 52/185
2023/0056986 A1 * 2/2023 Berg ..... B66C 1/666

FOREIGN PATENT DOCUMENTS

| | | | |
|---|---|---|---|
| CN | 204728590 U | * | 10/2015 |
| CN | 207003861 U | * | 2/2018 |
| CN | 207538350 U | * | 6/2018 |
| CN | 210918010 U | * | 7/2020 |
| CN | 212295395 U | * | 1/2021 |
| CN | 112324066 A | | 2/2021 |
| CN | 215054707 U | | 12/2021 |
| CN | 215211968 U | * | 12/2021 |

* cited by examiner

*Primary Examiner* — Rodney Mintz
(74) *Attorney, Agent, or Firm* — Cooper Legal Group, LLC

(57) ABSTRACT

The present application discloses an anti-seismic braced scissor stairs and a frame stairs system. The stairs includes a first platform, a second platform, a third platform, a fourth platform, a fifth platform and a sixth platform. A first stair slab and a first inclined beam are provided between the first platform and the fourth platform; a second stair slab and a second inclined beam are provided between the second platform and the third platform; a third stair slab and a third inclined beam are provided between the third platform and the sixth platform; a fourth stair slab and a fourth inclined beam are provided between the fourth platform and the fifth platform. The first inclined beam and the second inclined beam are crosswise arranged to form a first cross bracing, and the third inclined beam and the fourth inclined beam are crosswise arranged to form a second cross bracing.

10 Claims, 6 Drawing Sheets

ANTI-SEISMIC BRACED SCISSOR STAIRS AND FRAME STAIRS SYSTEM

CROSS-REFERENCE TO RELATED APPLICATION

The present application claims the priority to China application No. 202210882709.3, filed on Jul. 26, 2022. The entirety of China application No. 202210882709.3 is hereby incorporated by reference herein and made a part of this specification.

TECHNICAL FIELD

The present application relates to a field of civil engineering, in particular, to an anti-seismic braced scissor stairs and a frame stairs system.

BACKGROUND ART

In a design and a construction of building engineering, stairs exist in every building. How to ensure that there is sufficient "headroom" between the upper and lower stair slabs of the stairs, and how to ensure that the stair slabs of the stairs possess enough and more actual use width are key issues. However, in a design and a construction of the stairs, an available space is limited (In an architectural design, particularly, for stairs around some rooms with special functions, and stairs with special floor height due to planning of building functions, available design planning means are more limited), thus the headroom between the upper and lower stair slabs cannot meet a distance specified in relevant standards and regulations after the stairs of many buildings is designed and built, such that people will feel the stair slabs on their head are too close to themselves when walking in a staircase, or, the width of the stair slab is affected because the size of the staircase is limited by the architectural planning, so that the staircase is too narrow, and the people passing by will feel oppressed.

In a frame and frame-shear wall structure design system, the staircase is usually constructed by a beam-columns system. Compared with a core wall of a staircase in shear wall structure, this staircase has a small stiffness and a large flexibility, and is easy to swing to be damaged under an action of seismic horizontal thrust. Moreover, the staircase constructed based on a frame structure of the beam-columns system is easier to concentrate the seismic force than the staircase constructed based on the shear wall structure with integral walls. Under a condition that the stiffness of the staircase of the frame structure is larger than that of other positions and it is easier to concentrate the seismic force, under the action of seismic horizontal thrust, a building partition wall of the staircase is easy to be cracked and damaged, and the stair slabs of the stairs is easy to be cracked by being pulled in an earthquake, so there is a great potential safety hazards.

SUMMARY

In order to solve problems of poor seismic resistance and insufficient space utilization of shear stairs, the present application provides an anti-seismic braced scissor stairs and a frame stairs system.

In a first aspect, the present application provides an anti-seismic braced scissor stairs by adopting the following technical solutions:

an anti-seismic braced scissor stairs, including a first platform, a second platform, a third platform, a fourth platform, a fifth platform and a sixth platform; the first platform, the third platform and the fifth platform are connected with a wall at one side from top to bottom successively; the second platform, the fourth platform and the sixth platform are connected with a wall at the other side from top to bottom successively;

a first stair slab and a first inclined beam are provided between the first platform and the fourth platform;

a second stair slab and a second inclined beam are provided between the second platform and the third platform;

a third stair slab and a third inclined beam are provided between the third platform and the sixth platform;

a fourth stair slab and a fourth inclined beam are provided between the fourth platform and the fifth platform;

the first inclined beam and the second inclined beam are crosswise arranged to form a first cross bracing, and the first cross bracing is connected at two sides thereof with the first stair slab and the second stair slab, respectively;

the third inclined beam and the fourth inclined beam are crosswise arranged to form a second cross bracing, and the second cross bracing is connected at two sides thereof with the third stair slab and the fourth stair slab, respectively;

the first inclined beam is connected at one end thereof with a stair beam of the first platform, and connected at the other end thereof with the fourth inclined beam; a longitudinal axis of the first inclined beam is parallel to a longitudinal axis of the first stair slab;

the fourth inclined beam is connected at one end thereof with a stair beam of the fourth platform, and connected at the other end thereof with a stair beam of the fifth platform; a longitudinal axis of the fourth inclined beam is parallel to a longitudinal axis of the fourth stair slab;

the second inclined beam is connected at one end thereof with a stair beam of the second platform, and connected at the other end thereof with the third inclined beam; a longitudinal axis of the second inclined beam is parallel to a longitudinal axis of the second stair slab;

the third inclined beam is connected at one end thereof with a stair beam of the third platform, and connected at the other end thereof with a stair beam of the sixth platform; a longitudinal axis of the third inclined beam is parallel to a longitudinal axis of the third stair slab.

In the above technical solutions, the first cross bracing and the second cross bracing can not only be connected with the corresponding stair slab, but also bear a load. The first cross bracing and the second cross bracing crosswise arranged can effectively improve an anti-thrust performance, energy consumption seismic resistance and bearing strength of the whole stairs, and achieve an effective stability of the whole stairs.

In the above technical solutions, the first cross bracing and the second cross bracing form a whole cross bracing with a skew beam, then the stair slabs of different floors are able to be connected to form a spatial cross structure, which will not affect an actual use width of the corresponding stair slabs, but also improve a tensile strength and stability of the whole stairs.

In some embodiments, a perpendicular center plane of the first stair slab and the second stair slab is a first perpendicular plane;

a perpendicular center plane of the first cross bracing is consistent with the first perpendicular plane.

In the above technical solutions, the space between the stair slabs is fully utilized. An actually available space of the corresponding stair slabs will not be affected, but a bearing strength of the stair slabs themselves and a bearing strength of the platforms to the stair slabs can be improved, so that the whole stairs is not easy to swing and has a strong seismic resistance when subjected to an earthquake, and a damage to the stair slabs can be effectively reduced.

In some embodiments, a perpendicular center plane of the third stair slab and the fourth stair slab is a second perpendicular plane;

a perpendicular center plane of the second cross bracing is consistent with the second perpendicular plane, and consistent with the perpendicular center plane of the first cross bracing.

In the above technical solutions, a space between the stair slabs in different directions is fully utilized, so that it is more beautiful and practical. A matching arrangement of the second cross bracing and the first cross bracing can effectively prevent the stair slabs from cracking by being pulled in the earthquake, and a better safety is achieved.

In some embodiments, the second platform and the first platform are provided at a first horizontal plane; and/or, the fourth platform and the third platform are provided at a second horizontal plane; and/or, the sixth platform and the fifth platform are provided at a third horizontal plane.

In the above technical solutions, the platforms connected with the corresponding stair slabs may be multi-floor platforms arranged uniformly, or multi-floor platforms arranged in a staggered manner, which has a high flexibility and can meet requirements of buildings with different heights.

In some embodiments, the first stair slab and the third stair slab are located in a first vertical space;

the second stair slab and the fourth stair slab are located in a second vertical space;

the anti-seismic braced scissor stairs further includes a separation part configured to separate the first vertical space and the second vertical space;

the separation part is connected with the first cross bracing and the second cross bracing, respectively.

In the above technical solutions, the first cross bracing and the second cross bracing are embedded into the separation part, which can increase the actual use width of the stair slab. In addition, the first cross bracing and the second cross bracing can divide a whole of the separation part into small isolation areas. Under an action of earthquake, the small isolation areas are less likely to be scattered, thus the separation part can be effectively prevented from a shear failure.

In some embodiments, separation part has a thickness that is same as a thickness of the first cross bracing;

the second cross bracing has a thickness that is same as the thickness of the first cross bracing.

In the above technical solutions, a space is fully utilized. The separation part, the first cross bracing and the second cross bracing form a vertical overall structure, which can effectively limit a displacement of the wall and prevent the separation part from cracking under earthquake.

In a second aspect, the present application discloses a frame stairs system, including a first crossbeam, a second crossbeam, a third crossbeam, a fourth crossbeam, a fifth crossbeam, a sixth crossbeam, a first beam-column, a second beam-column, a third beam-column and a fourth beam-column;

the first crossbeam, the second crossbeam, the third crossbeam, the first beam-column and the second beam-column form a first bearing part;

the fourth crossbeam, the fifth crossbeam, the sixth crossbeam, the third beam-column and the fourth beam-column form a second bearing part;

a first platform, a second platform, a third platform, a fourth platform, a fifth platform and a sixth platform are provided between the first bearing part and the second bearing part;

the first platform, the third platform and the fifth platform are arranged in parallel and at intervals from top to bottom, and connected at two ends thereof with the first beam-column and the third beam-column, respectively;

the second platform, the fourth platform and the sixth platform are arranged in parallel and at intervals from top to bottom, and connected at two ends thereof with the second beam-column and the fourth beam-column, respectively;

a first stair slab and a first inclined beam are provided between the first platform and the fourth platform;

a second stair slab and a second inclined beam are provided between the second platform and the third platform;

a third stair slab and a third inclined beam are provided between the third platform and the sixth platform;

a fourth stair slab and a fourth inclined beam are provided between the fourth platform and the fifth platform;

the first inclined beam and the second inclined beam are crosswise arranged to form a first cross bracing, and the first cross bracing is connected at two sides thereof with the first stair slab and the second stair slab, respectively;

the third inclined beam and the fourth inclined beam are crosswise arranged to form a second cross bracing, and the second cross bracing is connected at two sides thereof with the third stair slab and the fourth stair slab, respectively;

the first bearing part, the second bearing part, the first platform, the second platform, the third platform, the fourth platform, the fifth platform and the sixth platform form an integrated outer frame.

In the above technical solutions, the first bearing part and the second bearing part can be embedded in a building wall around the staircase, without occupying the width of the stair slab, thus the actual use width of the stair slab is increased. By providing the integrated outer frame, on a premise of satisfying an output multiplication, the overall seismic resistance can be improved, the appearance is beautiful, and the arrangement of doors and windows will not be affected. The setting of the first cross bracing and the second cross bracing can effectively prevent the corresponding stair slab from cracking by being pulled in the earthquake.

In summary, the present application can achieve at least one of the following beneficial technical effects.

1. The anti-seismic braced scissor stairs provided in the first aspect of the present application can not only bear the corresponding stair slabs, but also improve the bearing of the corresponding stair slabs themselves, and connect the stair slabs at different floors together, which can effectively improve the anti-thrust performance, energy consumption seismic resistance and bearing strength of the whole stairs, and achieve effective stability of the whole stairs.

2. In the present application, the first cross bracing, the second cross bracing, and the corresponding stair slabs form a new form of braced connection stair slabs. By providing a cross-shaped cross bracing, a shape thereof is consistent with a development of seismic cracks, so that it can effectively prevent a development of the seismic cracks.

3. The technical solutions disclosed in the present application present a stairs with innovative ideas, which can effectively solve a space design of various extreme buildings, with good seismic resistance and high space utilization rate; the present application has a flexible structure, strong practicability and is convenient for promotion.

4. The present application can increase a horizontal and vertical space in the staircase; the thickness of the stair slab is reduced by changing a direction of force transmission of the stair slab.

DETAILED DESCRIPTION

The present application will be further described in detail below with reference to FIGS. 1-6.

Embodiment One

Figure 1:
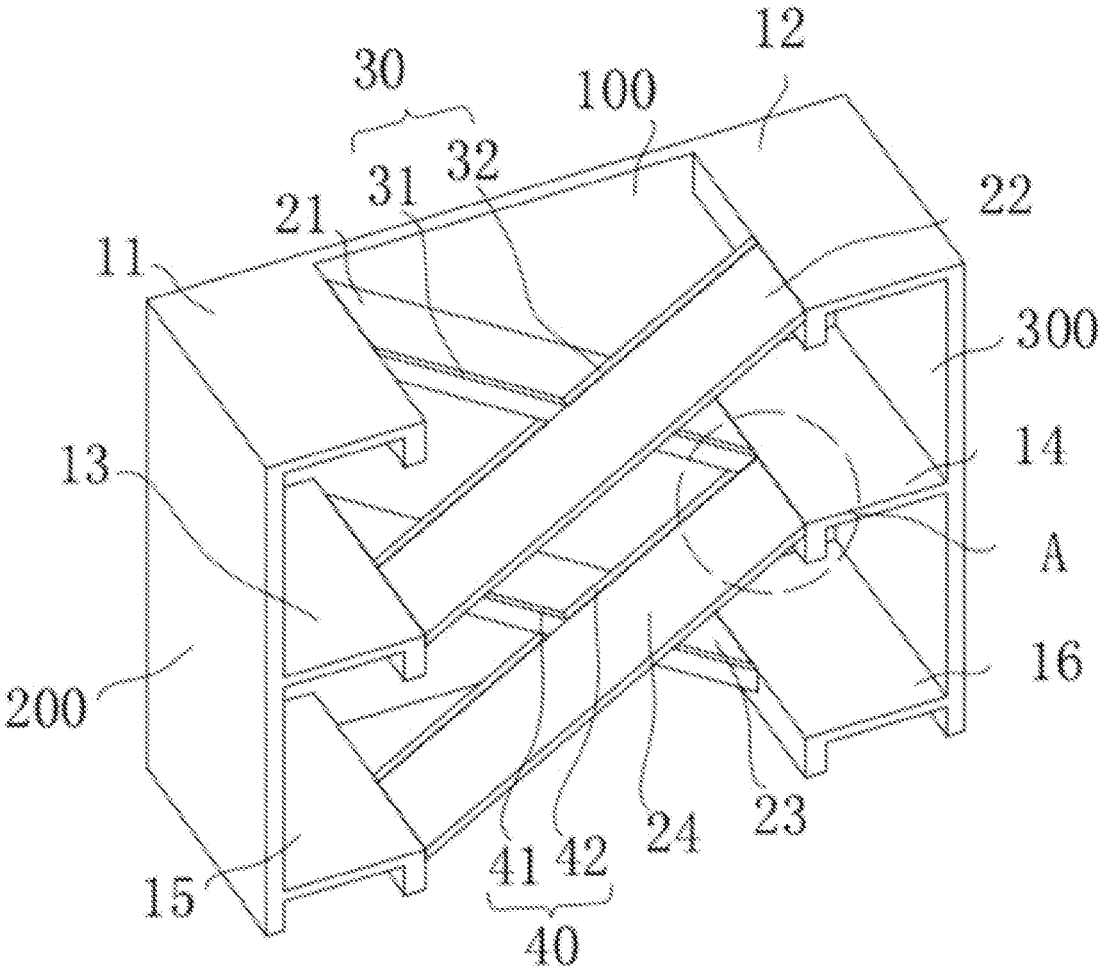
FIG. 1 is a sectional diagram of structure of anti-seismic braced scissor stairs in embodiment one of the present application.
Figure 2:
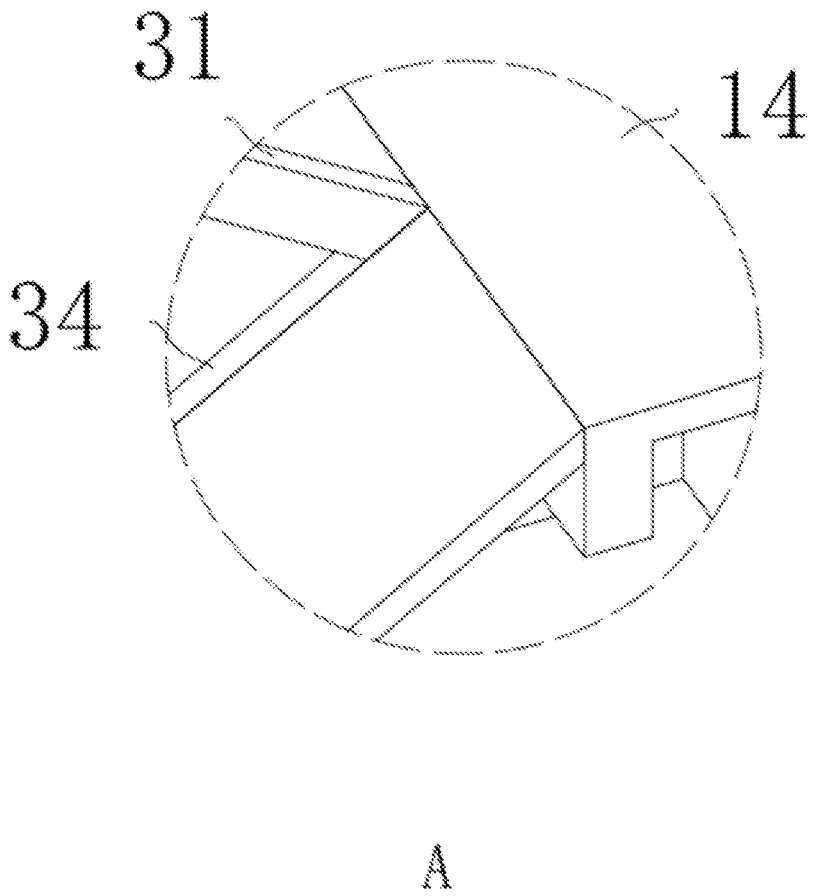
FIG. 2 is an enlarged view of part A in FIG. 1.

Referring to FIG. 1 and FIG. 2, in a first aspect, the present application discloses an anti-seismic braced scissor stairs, including a first platform 11, a second platform 12, a third platform 13, a fourth platform 14, a fifth platform 15 and a sixth platform 16. In particular, the first platform 11, the third platform 13 and the fifth platform 15 are connected with a wall at one side from top to bottom successively. That is, the corresponding platforms are connected at the width areas thereof with a first side wall 100, and connected at the length areas thereof with a second side wall 200. The second platform 12, the fourth platform 14 and the sixth platform 16 are connected with a wall at the other side from top to bottom successively. That is, the corresponding platforms are connected at the width areas thereof with a first side wall 100, and connected at the length areas thereof with a third side wall. In this embodiment, the first platform 11 is configured to be higher than the fourth platform 14, and the second platform 12 is configured to be higher than the third platform 13, and the third platform 13 is configured to be higher than the sixth platform 16, and the fourth platform 14 is configured to be higher than the fifth platform 15, forming a space scissor stairs, which has an obvious optimization effect on a use of horizontal and vertical space of staircase.

Corresponding platform beam or shear wall are provided around the first platform 11, the second platform 12, the third platform 13, the fourth platform 14, the fifth platform 15 and the sixth platform 16.

A first stair slab 21 and a first inclined beam 31 are provided between the first platform 11 and the fourth platform 14. The first stair slab 21 is connected at one end thereof with a stair beam of the first platform 11, and connected at the other end thereof with a stair beam of the fourth platform 14.

A second stair slab 22 and a second inclined beam 32 are provided between the second platform 12 and the third platform 13. The second stair slab 22 is connected at one end thereof with a stair beam of the second platform 12, and connected at the other end thereof with a stair beam of the third platform 13.

A third stair slab 23 and a third inclined beam 41 are provided between the third platform 13 and the sixth platform 16. The third stair slab 23 is connected at one end thereof with a stair beam of the third platform 13, and connected at the other end thereof with a stair beam of the sixth platform 16.

A fourth stair slab 24 and a fourth inclined beam 42 are provided between the fourth platform 14 and the fifth platform 15. The fourth stair slab 24 is connected at one end thereof with a stair beam of the fourth platform 14, and connected at the other end thereof with a stair beam of the fifth platform 15.

The first inclined beam 31 and the second inclined beam 32 are crosswise arranged to form a first cross bracing 30, and the first cross bracing 30 is connected at two sides thereof with the first stair slab 21 and the second stair slab 22, respectively. The third inclined beam 41 and the fourth inclined beam 42 are crosswise arranged to form a second cross bracing 40, and the second cross bracing 40 is connected at two sides thereof with the third stair slab 23 and the fourth stair slab 24, respectively. The first cross bracing 30 can not only bear the first stair slab 21 and the second stair slab 22, but also not affect an actually available step length of the corresponding stair slab. A space from top to bottom is fully utilized, and a middle space cross bracing is formed. The first stair slab 21 and the second stair slab 22, which were originally separated from each other, form a spatially connected whole, thus a bearing strength and a seismic resistance of the first stair slab 21 and the second stair slab 22 are effectively improved. The second cross bracing 40 can not only bear the third stair slab 23 and the fourth stair slab 24, but also not affect an actually available step length of the corresponding stair slab. The space from top to bottom is fully utilized, and the middle space cross bracing is formed. The third stair slab 23 and the fourth stair slab 24, which were originally provided separately from each other, form a spatially connected whole, thus the bearing strength and a seismic resistance of the third stair slab 23 and the fourth stair slab 24 are effectively improved.

Further, the first inclined beam 31 is connected at one end thereof with the stair beam of the first platform 11, and connected at the other end thereof with the fourth inclined beam 42; the fourth inclined beam 42 is connected at one end thereof with the stair beam of the fourth platform 14, connected at the other end thereof with the stair beam of the fifth platform 15; the second inclined beam 32 is connected at one end thereof with the stair beam of the second platform 12, and connected at the other end thereof with the third inclined beam 41; the third inclined beam 41 is connected at one end thereof with the stair beam of the third platform 13, and connected at the other end thereof with the stair beam of the sixth platform 16. By connecting the first inclined beam 31 with the fourth inclined beam 52, and connecting the second inclined beam 32 with the third inclined beam 41, structures are connected together to form an interconnected whole. Different from an independent setting of paths in different directions of scissor stairs in existing technologies, embodiments of the present application can effectively improve the overall tensile strength and overall stability without affecting an effective use space. By providing the first cross bracing 30 and the second cross bracing 40, a weight of the corresponding stair slab can be reduced, so as to realize a lightweight setting of the corresponding stair slab. Meanwhile, an enough headroom in the staircase can be kept, so that people will not feel oppressed, and the practicability is improved.

By providing the first cross bracing 30 and the second cross bracing 40, a force transmission mode of the stair slab is changed from transferring the force from the platform to the platform to transferring the force from the middle cross bracing to a braced stairs frame system. A thickness of the corresponding stair slab can be minimized, and a spacing between the upper and lower stair slabs can be increased. Meanwhile, the tensile strength of the corresponding stair slab in an earthquake can be effectively ensured.

In some embodiments, a longitudinal axis of the first inclined beam is parallel to a longitudinal axis of the first stair slab 21; a longitudinal axis of the second inclined beam is parallel to a longitudinal axis of the second stair slab 22; a longitudinal axis of the third inclined beam is parallel to a longitudinal axis of the third stair slab 23; a longitudinal axis of the fourth inclined beam is parallel to a longitudinal axis of the fourth stair slab 24. By a parallel setting of the stair beam and the corresponding stair slab, a beauty of the space is not be affected while bearing the stair slab. This parallel setting can prevent an unnecessary resistance, and improve the overall tensile strength and stability of the stairs.

A perpendicular center plane of the first stair slab 21 and the second stair slab 22 is a first perpendicular plane, and a perpendicular center plane of the third stair slab 23 and the fourth stair slab 24 is a second perpendicular plane. A perpendicular center plane of the first cross bracing 30 is consistent with the first perpendicular plane, and a perpendicular center plane of the second cross bracing 40 is consistent with the second perpendicular plane, and consistent with the perpendicular center plane of the first cross bracing 30. The space from top to bottom is fully utilized, and the overall stability is improved.

The second platform 12 and the first platform 11 are provided at a first horizontal plane, and the fourth platform 14 and the third platform 13 are provided at a second horizontal plane, and the sixth platform 16 and the fifth platform 15 are provided at a third horizontal plane.

When the first platform 11 and the second platform 12 are at the same horizontal plane, the third platform 13 and the fourth platform 14 are at the same horizontal plane, and the fifth platform 15 and the sixth platform 16 are at the same horizontal plane, a structure of the first cross bracing 30 is the same as that of the second cross bracing 40. The overall structure is symmetric; the bearing strength is higher; and an appearance is beautiful. The space between the stair slabs is fully utilized. The actually available space of the corresponding stair slabs will not be affected, but the bearing strength of the stair slabs themselves and a bearing strength of the platforms to the stair slabs can be improved, so that the whole stairs is not easy to swing and has a strong seismic resistance when subjected to the earthquake, and a damage to the stair slabs can be effectively reduced.

When the platforms at different floors are arranged in a staggered manner, an entrance and an exit at two opposite sides can be arranged at different heights, so that a high flexibility and practicability will be achieved.

By providing the first platform 11, the first stair slab 21, the fourth platform 14, the fourth stair slab 24 and the fifth platform 15, a space path in a first direction is formed; by providing the second platform 12, the second stair slab 22, the third platform 13, the third stair slab 23 and the sixth platform 16, a space path in a second direction is formed. The stair slabs in the two directions are independent from each other and will not intervene with each other. By providing the first cross bracing 30 and the second cross bracing 40, the first stair slab 21, the second stair slab 22, the third stair slab 23 and the fourth stair slab 24 are connected to form a spatially connected whole, so that the stability and the tension strength of the whole stairs can be improved. The structure of the first cross bracing 30 and the structure of the second cross bracing 40 are both cross shaped, which is consistent with a development of seismic cracks, so that it has a good effect on preventing a development of seismic cracks and effectively improves the seismic resistance of the whole stairs.

Embodiment Two

Figure 3:
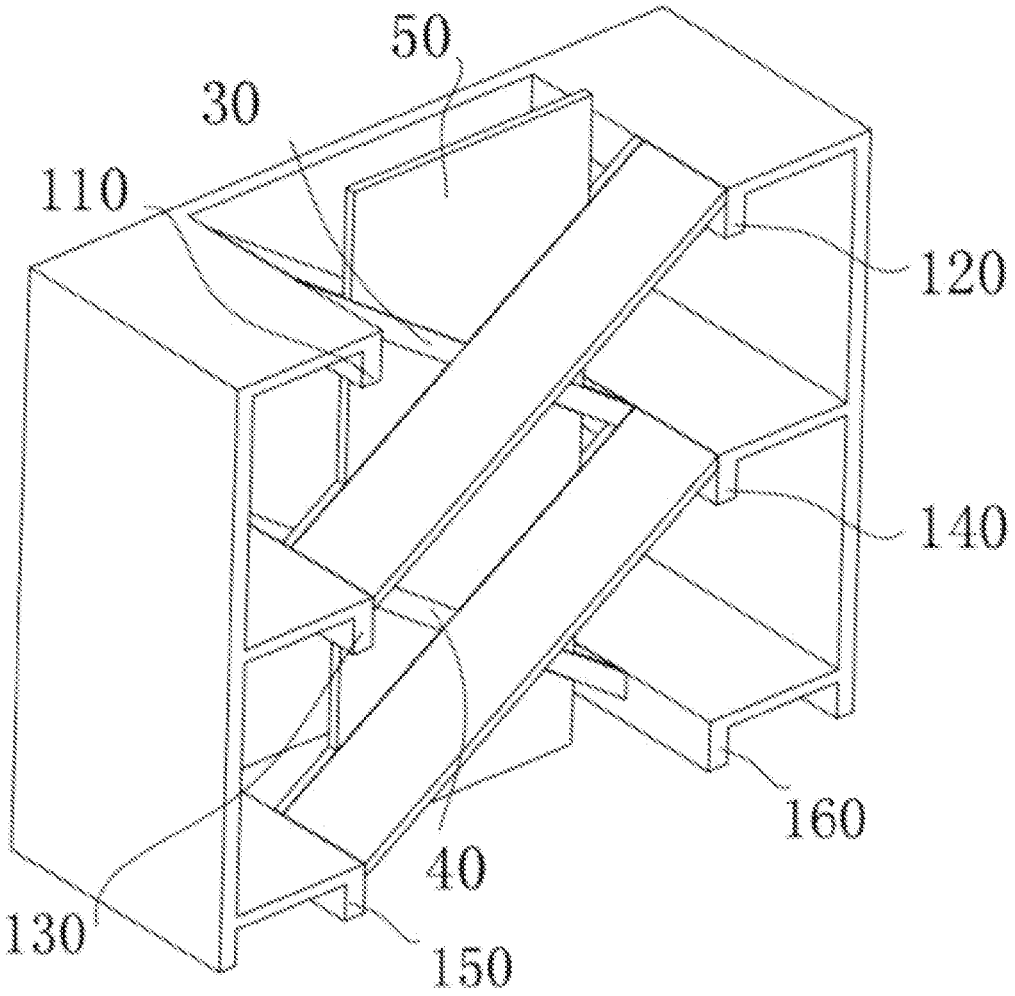
FIG. 3 is a sectional diagram of structure of anti-seismic braced scissor stairs in embodiment two of the present application.

Referring to FIG. 3, based on embodiment one, the anti-seismic braced scissor stairs further includes a separation part 50. In particular, the first stair slab 21 and the third stair slab 23 are located in a first vertical space, and the second stair slab 22 and the fourth stair slab 24 are located in a second vertical space. The separation part 50 is configured to separate the first vertical space and the second vertical space. The separation part 50 is connected with the first cross bracing 30 and the second cross bracing 40, respectively. Specifically, in the present application, the first cross bracing 30 and the second cross bracing 40 are embedded into the separation part 50. The first cross bracing 30 and the second cross bracing 40 can directly divide the large building separation part 50 located at a stairwell into small building isolation areas. Under an action of earthquake, the small isolation areas are less likely to be scattered, thus the separation part 50 can be effectively prevented from a shear failure.

In this embodiment, by matching the separation part 50 with the first cross bracing 30 and the second cross bracing 40, a section width of the brace matches a width of a building wall, so that an appearance of the building will not be affected, and the wall located at the stairwell can be divided.

In some embodiments, the separation part 50 has a thickness that is same as a thickness of the first cross bracing 30; the second cross bracing 40 has a thickness that is same as the thickness of the first cross bracing 30. The space is fully utilized, and the separation part 50, the first cross bracing 30 and the second cross bracing 40 form a vertical overall structure, which can effectively limit a displacement of the wall and prevent the separation part 50 from cracking under earthquake.

The separation part 50 is suspended by using the first cross bracing 30 and the second cross bracing 40, which can be seen as a relatively stable structure composed of the first cross bracing 30, the second cross bracing 40, a polygon and several triangles, thus a good lateral resistance under an action of horizontal earthquake is obtained.

When the separation part 50 is fixedly connected at the bottom with the ground, the separation part 50 can form an auxiliary bearing to the first cross bracing 30 and the second cross bracing 40, so as to improve the overall stability and seismic resistance.

In the present application, the stair beam of the first platform 11 is the first stair beam 110; the stair beam of the second platform 12 is the second stair beam 120; the stair beam of the third platform 13 is the third stair beam 130; the stair beam of the fourth platform 14 is the fourth stair beam 140; the stair beam of the fifth platform 15 is the fifth stair beam 150; the stair beam of the sixth platform 16 is the sixth stair beam 160.

In this embodiment, the separation part 50 is preferably a partition wall with light material.

Embodiment Three

Figure 4:
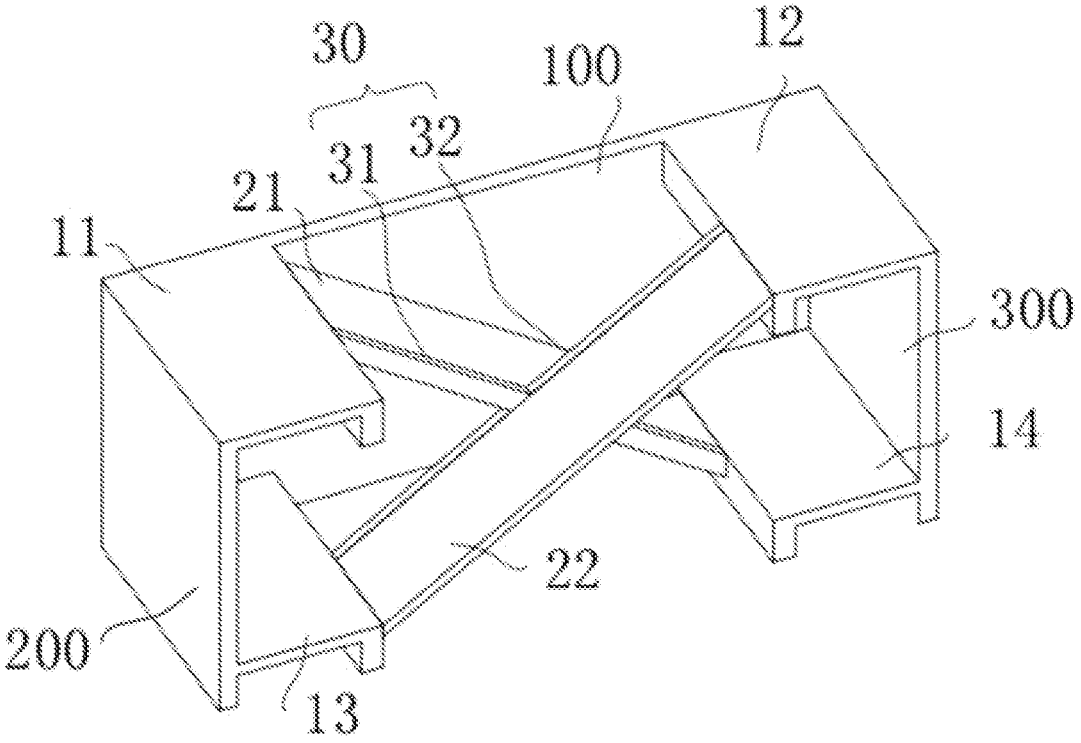
FIG. 4 is a sectional diagram of structure of anti-seismic braced scissor stairs in embodiment three of the present application.

Referring to FIG. 4, the anti-seismic braced scissor stairs disclosed in a second aspect of the present application includes a first platform 11, a second platform 12, a third platform 13 and a fourth platform 14. The first platform 11 and the third platform 13 are connected with the wall at one side from top to bottom successively, and the second platform 12 and the fourth platform 14 are connected with a wall at the other side from top to bottom successively. The first stair slab 21 and the first inclined beam 31 are provided between the first platform 11 and the fourth platform 14, and the second stair slab 22 and the second inclined beam 32 are provided between the second platform 12 and the third platform 13. The first inclined beam 31 and the second inclined beam 32 are crosswise arranged to form the first cross bracing 30, and the first cross bracing 30 is connected at two sides thereof with the first stair slab 21 and the second stair slab 22, respectively. This embodiment is a two-story spatial stair structure. When a space in actual construction is limited, the limited space can be fully utilized to maximize a space application by adopting the setting of this embodiment. The providing of the first cross bracing 30 will not affect the actually available width of the corresponding stair slab, but improve the bearing strength of the stair slab and effectively prevent breaking or cracking under earthquake.

Embodiment Four

Figure 5:
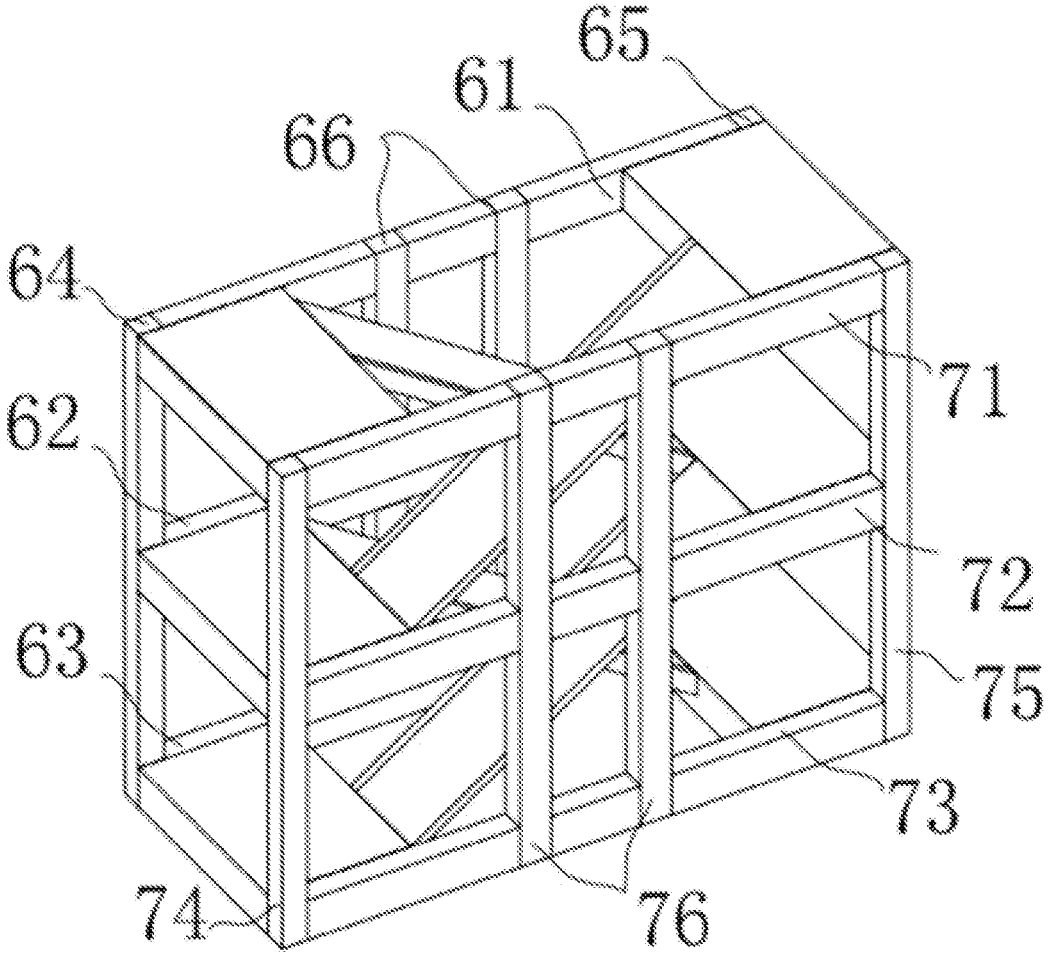
FIG. 5 is a diagram of structure of frame stairs system in embodiment one of the present application.

Referring to FIG. 5, a frame stairs system disclosed in a third aspect of the present application includes a first crossbeam 61, a second crossbeam 62, a third crossbeam 63, a fourth crossbeam 71, a fifth crossbeam 72, a sixth crossbeam 73, a first beam-column 64, a second beam-column 65, a third beam-column 74 and a fourth beam-column 75. The first crossbeam 61, the second crossbeam 62, the third crossbeam 63, the first beam-column 64 and the second beam-column 65 form a first bearing part 60. The fourth crossbeam 71, the fifth crossbeam 72, the sixth crossbeam 73, the third beam-column 74 and the fourth beam-column 75 form a second bearing part 70. The first bearing part 60 and the second bearing part 70 can be embedded in the building wall around the staircase, without occupying the width of the stair slab, thus the actually available width of the stair slab is increased.

The first platform 11, the second platform 12, the third platform 13, the fourth platform 14, the fifth platform 15 and the sixth platform 16 are provided between the first bearing part 60 and the second bearing part 70. The first platform 11, the third platform 13 and the fifth platform 15 are arranged in parallel and at intervals from top to bottom, and connected at two ends thereof with the first beam-column 64 and the third beam-column 74, respectively. The second platform 12, the fourth platform 14 and the sixth platform 16 are arranged in parallel and at intervals from top to bottom, and connected at two ends thereof with the second beam-column 65 and the fourth beam-column 75, respectively. In this embodiment, it is described in detail by taking three-story platform as an example. The provided four beam-column can not only bear the corresponding beam, but also bear the corresponding platform, thus there is enough space between adjacent platforms.

Specifically, the first stair slab 21 and the first inclined beam 31 are provided between the first platform 11 and the fourth platform 14; the second stair slab 22 and the second inclined beam 32 are provided between the second platform 12 and the third platform 13; the third stair slab 23 and the third inclined beam 41 are provided between the fourth platform 14 and the sixth platform 16; and the fourth stair slab 24 and the fourth inclined beam 42 are provided between the fourth platform 14 and the fifth platform 15. The first inclined beam 31 and the second inclined beam 32 are crosswise arranged to form the first cross bracing 30, and the first inclined beam 31 is connected at two sides thereof with the first stair slab 21 and the second stair slab 22, respectively. The third inclined beam 41 and the fourth inclined beam 42 are crosswise arranged to form the second cross bracing 40, and the second cross bracing 40 is connected at two sides thereof with the third stair slab 23 and the fourth stair slab 24, respectively.

The first bearing part 60, the second bearing part 70, the first platform 11, the second platform 12, the third platform 13, the fourth platform 14, the fifth platform 15 and the sixth platform 16 form an integrated outer frame. By providing the integrated outer frame, on a premise of satisfying an output multiplication, the overall seismic resistance can be improved; the appearance is beautiful; and an arrangement of doors and windows will not be affected. The providing of the first cross bracing 30 and the second cross bracing 40 can effectively prevent the corresponding stair slab from cracking by being pulled in the earthquake.

Further, the first bearing part 60 and the second bearing part 70 of the integrated outer frame can be embedded in the building wall, which can effectively limit the displacement of the wall, prevent the partition wall from cracking under the earthquake, and effectively prevent the partition wall from the shear failure.

For a normal slab-type stairs, the direction of force transmission of the stair slab is from the stair slab to the two stair platforms. Thus, when a distance between the two stair platforms in the an architectural design becomes greater, a span of the stair slabs will be larger, and a thickness of the stair slab will be thicker (The thickness of the stair slab is considered as one-twentieth to one-thirtieth of a clear span of the stair slabs, so a thickness of the cast-in-place concrete stair slab designed according to a current load code is easy to exceed 170 mm when the stair slab has a thickness close to 5 m), and a thickened stair slab will have a heavier dead weight, and will swing more violently and easily be damaged under horizontal earthquake.

In the present application, a side of the stair platform where the stair column is located is provided with the crossbeam, and the other side is provided with the cross bracing. The force transmission path is changed to be: the stair slab transmit the force to the crossbeams at the left and right sides thereof and the corresponding cross bracing, then a crossbeam at one side of the stair slab is connected with the stair column, so that the force is transmitted to the stair column; the cross bracing at the other side of the stair slab directly transmits the force to a platform beam between the two stair columns, and then the platform beam transmits the force to the stair columns at both sides thereof (An intersecting position of the cross bracing and the platform beam is in a platform beam span close to the brace); because the direction of the force transmission of the stair slab is changed to be a width direction of the stair slab (The width of stairs is between 1100 mm and 1400 mm for two people pass, and between 1500 mm and 1800 mm for three people pass. In addition, a service performance of the building should also be considered, not less than 1100 mm for a residential building, and not less than 1300 mm for a public building. Meanwhile, it is required to meet minimum requirements for the width of stair flight in various building design codes). Because the span in the width direction of the stair slab usually is very small, the thickness of the cast-in-place stair slab can refer to Article 3.6.3 of 3.6 Floor Structure in "Technical Specification for Concrete Structures of Tall Buildings [with clause explanation] JGJ3-2010". Generally, the thickness of a floor cast-in-place slab shall not be less than 80 mm, that of the embedded concealed pipe shall not be less than 100 mm, and that of a top slab shall not be less than 120 mm. The thickness of cast-in-place concrete stair slab is reduced to a thinnest structural thickness of 80 mm and a reinforcement is made; a vertical distance between the upper and lower stair slabs will be greatly increased and the dead weight of stair slab will be reduced due to a thinning of the stair slab, the force transmission path is changed by this structural design means, which brings a great benefit to the headroom and reduction of the seismic force on the stair slab.

Meanwhile, the corresponding cross bracing is located at the stairwell in a general plane design of the stairs, and does not redundantly occupy the actual use width of the stair slab. In this present application, the crossbeam at the other side of the stair slab is embedded into the building wall around the staircase with the stair column, which also does not redundantly occupy the actual use width of the stair slab.

When the overall structure is a concrete, a beam type skew beam scissor cross bracing at one side of the stair slab, and the crossbeam and the vertical beam at the other side that constitute redundant constraints can effectively prevent the concrete stair slab from cracking by being pulled in the earthquake.

Under the action of horizontal earthquake, a core system of force transmission in the frame structure is the corresponding beam-column. The beam-column will show a certain tensile and compressive properties under an action of horizontal and vertical loads, distinguished by a force neutral axis thereof (Especially for a beam-column structure with a full-length reinforcement and stirrup densification in a core area, the seismic capacity is significantly improved). However, the slab is not a seismic member (The stair slab also is essentially a slab), thus the slab often cracks by being violently pulled under the action of horizontal earthquake. In particular, for a beam type stairs, by establishing a beam-column force transmission system by providing beams at both sides of the stair slab, the stair slab can be prevent from cracking by being pulled. Even if both sides of the stair slab are provided with the beams, when the frame structure suffers a high intensity earthquake, the structure is still likely to be damaged because the frame system of the staircase swings too violently. In this design, based on the beam-type stairs, one side of the stair slab is the cross bracing, and the other side is the skew beam integrated with a staircase frame, and a redundant constrained vertical beam of the whole staircase frame is provided to make the staircase more stable and safer.

Further, two first auxiliary beam-columns 66 are provided between the first beam-column 64 and the second beam-column 65. The two first auxiliary beam-columns 66 are arranged close to the middle, and large independent areas are formed by the two first auxiliary beam-columns 66 with the first beam-column 64 and the second beam-column 65, respectively, which is convenient for arrangement of windows or entrances and exits. Two second auxiliary beam-columns 76 are provided between the third beam-column 74 and the fourth beam-column 75. The two second auxiliary beam-columns 76 are arranged close to the middle, and large independent areas are formed by the two second auxiliary beam-columns 76 with the third beam-column 74 and the fourth beam-column 75, respectively. By providing the first auxiliary beam-column 66 and the second auxiliary beam-column 76, it not only increases the rigidity and seismic resistance of the staircase of the building, but also increases a structural entirety and effectively improves the overall bearing strength.

Further, the first auxiliary beam-column 66 penetrates the first crossbeam 61, the second crossbeam 62 and the third crossbeam 63; the second auxiliary beam-column 76 penetrates the fourth crossbeam 71, the fifth crossbeam 72 and the sixth crossbeam 73.

For the same reason as the skew beam cross bracing dividing the partition wall, a side stair beam of the stair slab forms the concrete diagonal brace, and is embedded into the building partition wall built around the staircase together with the stair column and a stair platform beam, which also achieves an effect of dividing the partition wall and increases the seismic resistance and entirety of the staircase. Meanwhile, the side stair beam of the stair slab also increases the force transmission path for the frame staircase, thus effective redundant constraints are formed.

Embodiment Five

Figure 6:
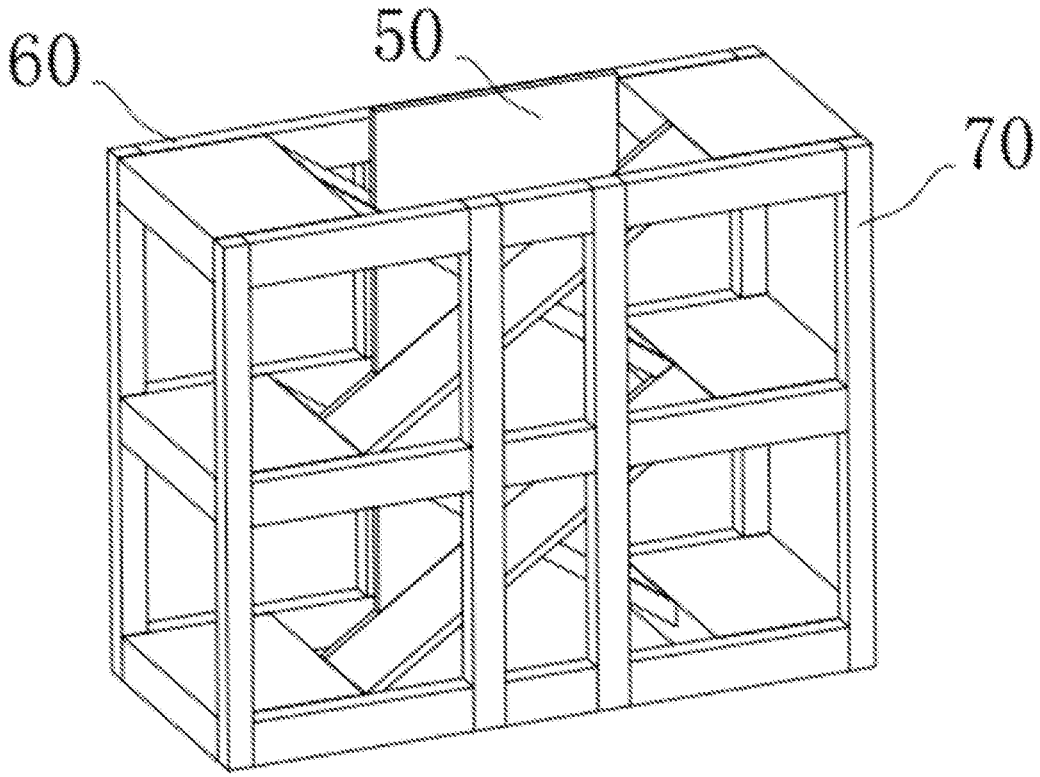
FIG. 6 is a diagram of structure of frame stairs system in embodiment two of the present application.

Referring to FIG. 6, based on embodiment four, the system further includes the separation part 50. The first stair slab 21 and the third stair slab 23 are located in the first vertical space, and the second stair slab 22 and the fourth stair slab 24 are located in the second vertical space. The separation part 50 is connected with the first cross bracing 30 and the second cross bracing 40, respectively. The limited space can be fully utilized to maximize the space application. The first bearing part 60 and the second bearing part 70 can be embedded in the building wall around the staircase, which does not occupy the width of the stair slab and increases the actually available width of the stair slab. By providing the integrated outer frame, on the premise of satisfying the output multiplication, the overall seismic resistance can be improved, the appearance is beautiful, and the arrangement of doors and windows will not be affected. The arrangement of the first cross bracing 30 will not affect the actually available width of the corresponding stair slab, but improve the bearing strength of the stair slab and effectively prevent breaking or cracking under earthquake. In actual construction, the beam and brace in the present application can be embedded into the building wall located at the stairwell, and the section width of the brace matches the width of the building wall, so that the appearance of the building will not be affected, and the wall located at the stairwell can be divided. The stair column and the separation part 50 located at the other side of the stair slab can be embedded into the partition wall of the building, and the size matches the partition wall, so as to achieve an anti-seismic resistance effect of the partition wall of the building, and maximize a protection to the appearance of the staircase.

In the present application, the first cross bracing 30, the second cross bracing 40, the corresponding stair slabs, the corresponding crossbeams, the corresponding stair columns and the corresponding stair platforms form an organic anti-side-energy consumption whole, which can not only divide the partition wall, but also increase structural redundant constraint dissipation seismic force.

Generally, the scissor stairs are divided into the slab-type stairs and the beam-type stairs. Compared with the slab scissor stairs that has the most common structural form, the present application embodies the advantages of beam-type stairs. For example, the direction of force transmission of the stair slab is changed to shorten the span of the slab, so that the thickness of the corresponding stair slab can be minimized; the spacing between the upper and lower stair slabs can be increased; and the stair beams at both sides of the stair slab effectively prevent the stair slab from cracking by being pulled in the earthquake. Compared with a common single-span multi-flights beam type stairs, the present application is closer to a relatively rare beam-type scissor stairs in terms of the structural form. Compared with the beam-type scissor stairs, in the present application, the stair beams at a side of the two scissor stair slabs close to the stairwell intersect with each other to form an energy consumption brace, which is more beneficial to the seismic resistance and a space expansion of the staircase. Moreover, the stair beams at two side of the beam-type scissor stairs generally does not intervene with each other, and can be simplified as beams during calculation. However, in the present application, because the two stair beams intersect with each other to form the brace, during calculation, first they should be divided into four rods centered at a brace joint, and it is considered to replace a load bearing of the stair beam for calculation (It is also necessary to adjust an embedded end of the rod member to meet the actual engineering simplification). Meanwhile, it is required to model the whole frame staircase, remove redundant constrained inclined beams at both sides of the staircase frame and only leaving the staircase frame and the platform and energy consumption brace of the stairs, and model force simulation under the action of horizontal earthquake. For simulation results, only a part of rods can be taken as valid data (Data acquisition needs to be judged according to certain experience). Meanwhile, a final design of structural reinforcement (or structural steel skeleton) should be based on a research and development of the specification and adopt a design method of semi-experience and semi-theory, and ensure that the design structure can be constructed normally by selecting an appropriate configuration (Without combining with a construction experience, the possible problems are that the stirrups are too dense to the vibrate the concrete, and a beam section is too thin while a main reinforcement is too thick, resulting in an insufficient space between the steel bars, etc). Therefore, the present application has high technological content than similar stairs in field of structural design and construction. Meanwhile, dealing with embedded ends of different structures of steel braces or the concrete, diversified structural simplification and rich practical forms need rich technical experience.

It should be noted that, both a concrete structure and a steel structure can be selected for this present application, which are within the protection scope of the present application.

When the steel structure is selected, an intersecting connection node of the first inclined beam 31 and the second inclined beam 32 in the first cross bracing 30 can be provided with stiffeners accordingly, so as to ensure that a structural stress performance and a force transmission path of the brace joint are not interrupted. Specifically, the intersecting connection nodes of the first inclined beam 31 and the second inclined beam 32, which is a rhombus node structure, is divided into four triangular structures by using central cross stiffeners to make the brace joint more stable.

Further, complex intersecting nodes of head support end of intersecting end of the stair beam corresponding to the platform can be provided with the stiffeners, so as to improve the bearing strength of different inclined beams when intersecting with each other.

A step construction of the steel structure at the corresponding stair slab is divided into multi-layer surface layer and single-layer surface layer. After an L-shaped step plate is welded, it can be left untreated, or a rubber surface treatment can be carried out at the steel structure of the step plate directly (single-layer surface treatment). Or, miniature shear connectors can be welded at the surface of steel step plate (A length thereof does not exceed a concrete surface layer), the concrete surface layer can be constructed at the step plate with the shear connectors, and a thin rubber surface layer can be constructed at a surface of the concrete surface layer additionally.

When the corresponding cross bracing is a steel box girder skew beam cross bracing, the difference from a steel I-beam cross bracing is: the intersecting position where the steel box girder is located of the brace intersecting node is provided with the stiffeners, and fixed prefabricated nodes are made for assembling with four-way steel box girder in various forms, such as by bolting or welding (According to the different forms, the brace intersecting node can be designed as hinged connection or fixed connection, only part of basic form design principle are shown based on technical confidentiality).

In addition, the steel L-shaped step plate of steel box girder can be welded not only on the top of the steel box girder, but also at webs at both sides of the steel box girder. However, for the steel I-beam, adhering to a principle that the upper and lower side plates are under tension or the stress web is prevent from being stressed directly, the step plate is not suitable for welding on the web in terms of appearance and stress (A main reason is that the section is easy to be twisted, the steel I-beam can be welded at the web when it is assumed that two flange slabs are bent, the web is sheared, and a load is not large. That is, it is can be welded at the web when an engineering has no load or after the load is unloaded). Generally, a strength of steel does not change much when a temperature is below 200° C.; the strength decreases, the plasticity increases, and a yield platform disappears, when a temperature exceeds 300° C.; the strength decreases by 90% at 550° C.; the strength is substantially lost when the temperature is above 550° C. Generally, a local temperature of a welding point is above 1350° C. during welding, thus a welding of steel members under a load state needs extreme caution.

It is regulated in "Technical Specification for Welding of Steel Structure of Building" that during reinforcement under the load state, a bearing capacity of components and connections shall be calculated and checked according to an actual load during reinforcement (including necessary construction load), and the load on the structure shall be removed as much as possible.

The above all are better embodiments of the present application, and do not limit the protection scope of the present application. Therefore, any equivalent changes made according to the structure, shape and principle of the present application should fall within the protection scope of the present application.

What is claimed is:

1. An anti-seismic braced scissor stairs, comprising:

a first platform, a second platform, a third platform, a fourth platform, a fifth platform and a sixth platform; the first platform, the third platform and the fifth platform are connected with a wall at one side from top to bottom successively; the second platform, the fourth platform and the sixth platform are connected with a second wall at a second side from top to bottom successively;

a first stair slab and a first inclined beam are provided between the first platform and the fourth platform;

a second stair slab and a second inclined beam are provided between the second platform and the third platform;

a third stair slab and a third inclined beam are provided between the third platform and the sixth platform;

a fourth stair slab and a fourth inclined beam are provided between the fourth platform and the fifth platform;

the first inclined beam and the second inclined beam are crosswise arranged to form a first cross bracing, and the first cross bracing is connected at two sides of the first cross bracing with the first stair slab and the second stair slab, respectively;

the third inclined beam and the fourth inclined beam are crosswise arranged to form a second cross bracing, and the second cross bracing is connected at two sides of the second cross bracing with the third stair slab and the fourth stair slab, respectively;

the first inclined beam is connected at one end of the first inclined beam with a stair beam of the first platform, and connected at a second end of the first inclined beam with the fourth inclined beam; a longitudinal axis of the first inclined beam is parallel to a longitudinal axis of the first stair slab;

the fourth inclined beam is connected at one end of the fourth inclined beam with a stair beam of the fourth platform, and connected at a second end of the fourth inclined beam with a stair beam of the fifth platform; a longitudinal axis of the fourth inclined beam is parallel to a longitudinal axis of the fourth stair slab;

the second inclined beam is connected at one end of the second inclined beam with a stair beam of the second platform, and connected at a second end of the second inclined beam with the third inclined beam; a longitudinal axis of the second inclined beam is parallel to a longitudinal axis of the second stair slab;

the third inclined beam is connected at one end of the third inclined beam with a stair beam of the third platform, and connected at a second end of the third inclined beam with a stair beam of the sixth platform; a longitudinal axis of the third inclined beam is parallel to a longitudinal axis of the third stair slab.

2. The anti-seismic braced scissor stairs according to claim 1, wherein, the second platform and the first platform are provided at a first horizontal plane.

3. The anti-seismic braced scissor stairs according to claim 1, wherein, the fourth platform and the third platform are provided at a second horizontal plane.

4. The anti-seismic braced scissor stairs according to claim 1, wherein, the sixth platform and the fifth platform are provided at a third horizontal plane.

5. The anti-seismic braced scissor stairs according to claim 1, wherein, a perpendicular center plane of the first stair slab and the second stair slab is a first perpendicular plane;

a perpendicular center plane of the first cross bracing is consistent with the first perpendicular plane.

6. The anti-seismic braced scissor stairs according to claim 5, wherein, a perpendicular center plane of the third stair slab and the fourth stair slab is a second perpendicular plane;

a perpendicular center plane of the second cross bracing is consistent with the second perpendicular plane, and consistent with the perpendicular center plane of the first cross bracing.

7. The anti-seismic braced scissor stairs according to claim 1, wherein, the first stair slab and the third stair slab are located in a first vertical space;

the second stair slab and the fourth stair slab are located in a second vertical space;

the anti-seismic braced scissor stairs further comprise a separation part configured to separate the first vertical space and the second vertical space;

the separation part is connected with the first cross bracing and the second cross bracing, respectively.

8. The anti-seismic braced scissor stairs according to claim 7, wherein, the separation part has a thickness that is same as a thickness of the first cross bracing;

the second cross bracing has a thickness that is same as the thickness of the first cross bracing.

9. An anti-seismic braced scissor stairs, comprising:

a first platform, a second platform, a third platform, a fourth platform, a fifth platform and a sixth platform; the first platform, the third platform and the fifth platform are connected with a first support at one side from top to bottom successively; the second platform, the fourth platform and the sixth platform are connected with a second support at a second side from top to bottom successively;

a first stair slab and a first inclined beam are provided between the first platform and the fourth platform;

a second stair slab and a second inclined beam are provided between the second platform and the third platform;

a third stair slab and a third inclined beam are provided between the third platform and the sixth platform;

a fourth stair slab and a fourth inclined beam are provided between the fourth platform and the fifth platform;

the first inclined beam and the second inclined beam are crosswise arranged to form a first cross bracing, and the first cross bracing is connected at two sides of the first cross bracing with the first stair slab and the second stair slab, respectively;

the third inclined beam and the fourth inclined beam are crosswise arranged to form a second cross bracing, and the second cross bracing is connected at two sides the second cross bracing with the third stair slab and the fourth stair slab, respectively;

the first inclined beam is connected at one end of the first inclined beam with a stair beam of the first platform, and connected at a second end of the first inclined beam with the fourth inclined beam; a longitudinal axis of the first inclined beam is parallel to a longitudinal axis of the first stair slab;

the fourth inclined beam is connected at one end of the fourth inclined beam with a stair beam of the fourth platform, and connected at a second end of the fourth inclined beam with a stair beam of the fifth platform; a longitudinal axis of the fourth inclined beam is parallel to a longitudinal axis of the fourth stair slab;

the second inclined beam is connected at one end of the second inclined beam with a stair beam of the second platform, and connected at a second end of the second inclined beam with the third inclined beam; a longitudinal axis of the second inclined beam is parallel to a longitudinal axis of the second stair slab;

the third inclined beam is connected at one end of the third inclined beam with a stair beam of the third platform, and connected at a second end of the third inclined beam with a stair beam of the sixth platform; a longitudinal axis of the third inclined beam is parallel to a longitudinal axis of the third stair slab.

10. A frame stairs system, comprising:

a first crossbeam, a second crossbeam, a third crossbeam, a fourth crossbeam, a fifth crossbeam, a sixth crossbeam, a first beam-column, a second beam-column, a third beam-column and a fourth beam-column;

the first crossbeam, the second crossbeam, the third crossbeam, the first beam-column and the second beam-column define a first bearing part;

the fourth crossbeam, the fifth crossbeam, the sixth crossbeam, the third beam-column and the fourth beam-column define a second bearing part;

a first platform, a second platform, a third platform, a fourth platform, a fifth platform and a sixth platform are provided between the first bearing part and the second bearing part;

the first platform, the third platform and the fifth platform are arranged in parallel and at intervals from top to bottom, and connected at two ends of the first platform, the third platform and the fifth platform with the first beam-column and the third beam-column, respectively;

the second platform, the fourth platform and the sixth platform are arranged in parallel and at intervals from top to bottom, and connected at two ends of the second platform, the fourth platform and the sixth platform with the second beam-column and the fourth beam-column, respectively;

a first stair slab and a first inclined beam are provided between the first platform and the fourth platform;

a second stair slab and a second inclined beam are provided between the second platform and the third platform;

a third stair slab and a third inclined beam are provided between the third platform and the sixth platform;

a fourth stair slab and a fourth inclined beam are provided between the fourth platform and the fifth platform;

the first inclined beam and the second inclined beam are crosswise arranged to form a first cross bracing, and the first cross bracing is connected at two sides of the first cross bracing with the first stair slab and the second stair slab, respectively;

the third inclined beam and the fourth inclined beam are crosswise arranged to form a second cross bracing, and the second cross bracing is connected at two sides of the second cross bracing with the third stair slab and the fourth stair slab, respectively;

the first bearing part, the second bearing part, the first platform, the second platform, the third platform, the fourth platform, the fifth platform and the sixth platform form an integrated outer frame;

the first inclined beam is connected at one end of the first inclined beam with a stair beam of the first platform, and connected at a second end of the first inclined beam with the fourth inclined beam; a longitudinal axis of the first inclined beam is parallel to a longitudinal axis of the first stair slab;

the fourth inclined beam is connected at one end of the fourth inclined beam with a stair beam of the fourth platform, and connected at a second end of the fourth inclined beam with a stair beam of the fifth platform; a longitudinal axis of the fourth inclined beam is parallel to a longitudinal axis of the fourth stair slab;

the second inclined beam is connected at one end of the second inclined beam with a stair beam of the second platform, and connected at a second end of the second inclined beam with the third inclined beam; a longitudinal axis of the second inclined beam is parallel to a longitudinal axis of the second stair slab;

the third inclined beam is connected at one end of the third inclined beam with a stair beam of the third platform, and connected at a second end of the third inclined beam with a stair beam of the sixth platform; a longitudinal axis of the third inclined beam is parallel to a longitudinal axis of the third stair slab.

* * * * *